US005511371A

United States Patent [19]

Kaufmann

[11] Patent Number: 5,511,371

[45] Date of Patent: Apr. 30, 1996

[54] SYSTEM FOR INCREASING THE PRODUCTION OF SPINNING MACHINES

[75] Inventor: Christoph Kaufmann, Uster, Switzerland

[73] Assignee: Zellweger Luwa AG, Switzerland

[21] Appl. No.: 274,783

[22] Filed: Jul. 14, 1994

[30] Foreign Application Priority Data

Jul. 14, 1993 [CH] Switzerland ..... 02108/93

[51] Int. Cl.[6] ..... DO1H 13/14

[52] U.S. Cl. ..... 57/264

[58] Field of Search ..... 57/264, 265; 264/470; 395/900

[56] References Cited

U.S. PATENT DOCUMENTS 5,322,089 6/1994 Yamada ..... 364/470 X
5,384,934 1/1995 Dämmig ..... 395/900 X

FOREIGN PATENT DOCUMENTS 461636 12/1991 European Pat. Off. ..... 57/264
0548023 6/1993 European Pat. Off. .
0553483 8/1993 European Pat. Off. .
153709 1/1982 Germany ..... 57/264

OTHER PUBLICATIONS

Uster News Bulletin, "The detection of end breaks in ring spinning", No. 27, Aug. 1979.

Terano, Toshiro et al, "Fuzzy Systems Theory and Its Applications", pp. 174–185.

Yeung, M. F. et al, "An On Line Intelligent Control Scheme for Tension Control", Aug. 1992.

*Primary Examiner*—Joseph J. Hail, III
*Attorney, Agent, or Firm*—Burns, Doane, Swecker & Mathis

[57] ABSTRACT

The system includes a control system for deriving control variables from parameters which influence the productivity of the spinning machine (RS). Besides parameters which are measured by sensors, for the purposes of the control consideration is also given to those parameters which are not measurable or measurable only with difficulty. The last-mentioned parameters are included in the control system by means of a fuzzy logic, for which purpose the control system exhibits a fuzzy controller (FC).

7 Claims, 2 Drawing Sheets

SYSTEM FOR INCREASING THE PRODUCTION OF SPINNING MACHINES

The present invention relates to a system for increasing the production of spinning machines, having sensors for measuring parameters which influence the production, and having a control system for deriving control variables from these parameters and for forming regulated variables for the spinning machine from the control variables obtained, in which those parameters which exhibit an unambiguous mathematical interrelationship with the respective control variable are included in the control system by conventional algorithms.

With the nowadays known systems of this type, an increase in production is possible only in circumstances in which the individual parameters, such as for example the number of thread breaks, climate, dust accumulation, air circulation, are precisely determinable and their effects on the spinning process are known. In other words, this means that in each instance an unambiguous mathematical interrelationship must exist between parameter and control variable. Since this condition is however applicable in all instances only to specified individual parameters in a specified spinning works and in no case generally, in the known systems only very few parameters can be utilized for the purpose of increasing production, so that even the possibility of influencing the production and thus also the possibility of increasing the same is only relatively slight.

The object of the invention is to specify a system for increasing the production of spinning machines, which system permits an improved influencing of the production and in which system a larger number of parameters can be used for the purpose of obtaining the control variables.

According to the invention, this object is achieved in that further parameters, which are in particular not measurable or measurable only with difficulty, can be input into the control system, and in that those parameters which exhibit no unambiguous mathematical interrelationship with the respective control variable are included in the control system by means of a fuzzy logic.

The essential difference of the fuzzy logic as compared with the traditional control technology resides in that the former requires no model of the process to be controlled, and in that the parameters exhibit not only a single defined value, but a plurality of indefinite quantities, the so-called fuzzy sets.

The system according to the invention thus has two essential advantages: on the one hand, not all parameters need to be available as a mathematically defined function of the control variables, and on the other hand, also, not all parameters necessarily need to be measurable using a sensor system. Both advantages lead to a situation in which parameters perceived by the operating personnel can also be input into the system, and this in turn means a considerable expansion of the range of usable parameters.

In the text which follows, the invention is explained in greater detail with reference to an embodiment and to the drawings; in the drawings.

Figure 1:
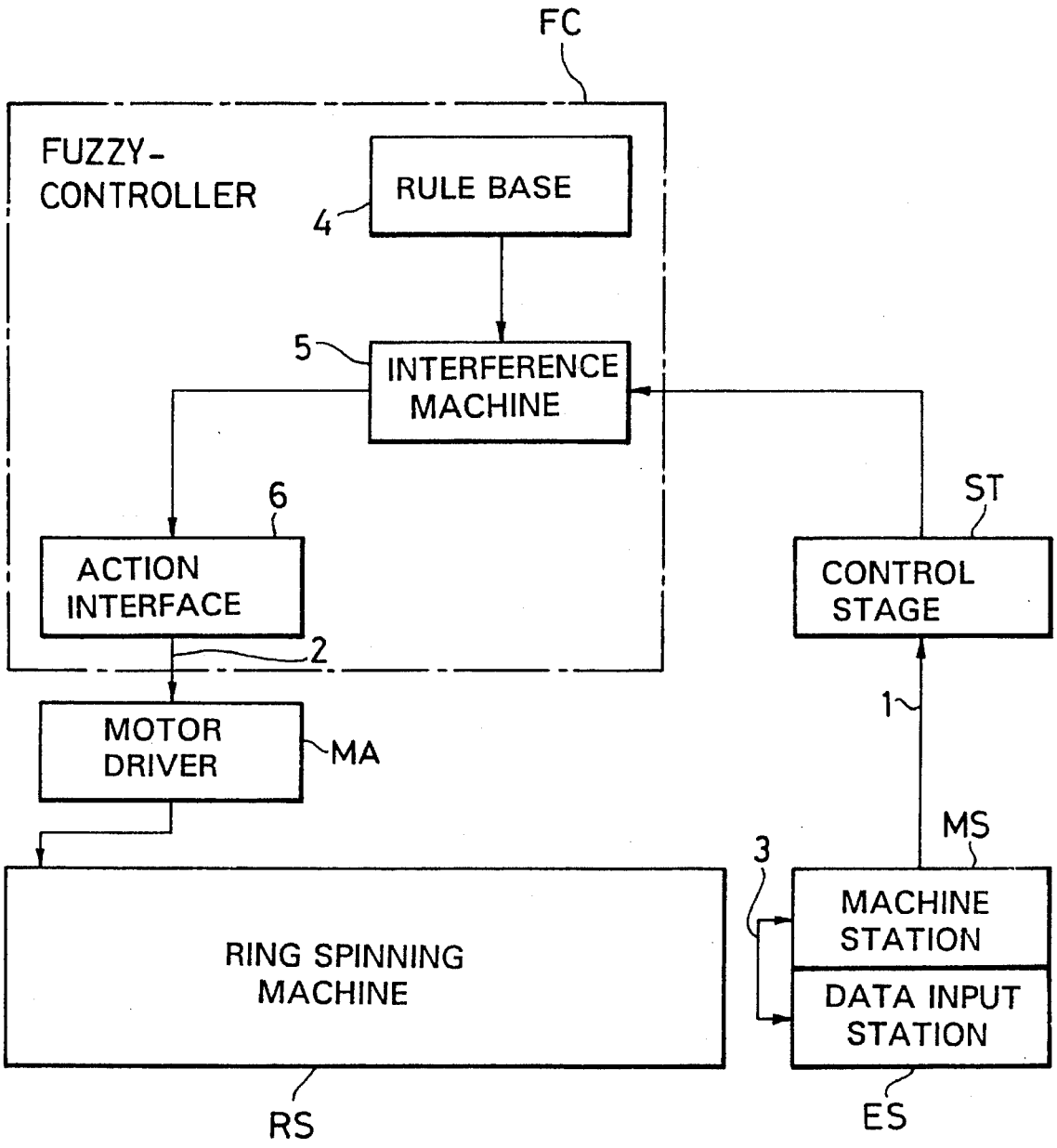
FIG. 1 shows the structure of a control system according to the invention.

FIG. 1 shows a block pictorial representation of a control system for a ring spinning machine RS, in which the control system is preferably based on the known data system USTER RINGDATA (USTER—registered trade mark of Zellweger Uster AG) and also makes use of components known from that system. These known components are in particular a so-called machine station MS, to which the various sensors for parameters to be recorded are connected, a machine input station ES for data input, such as article change, or data specification, such as slow speed spindle report, and a motor drive MA of the ring spinning machine RS.

The sensors mentioned are for example a migration sensor provided for each machine side and guided along the ring rail, an underwinding sensor and a production sensor. The production sensor records the revolutions of the discharge cylinder on the draft system and delivers basic information on production quantities and delivery rates, frequency and duration of relatively lengthy standstills and the like. The underwinding sensor is employed to register the underwinding setting of the ring rail in order to record the number and duration of the cop takeoffs. The migration sensor is provided one for each side of the machine and is guided along the ring rail. In this case, it contactlessly records the rotational movement of the ring drivers and delivers information on thread breaks at each spinning location and the average time to overcome the same, as well as on the average speed of rotation of the ring drivers and thus on the spinning locations with an excessively low speed of rotation.

The machine station MS is connected via a line 1 to a control stage ST, which is also designated as central unit in the USTER RINGDATA data system and in which inter alia the information, obtained from the machine station MS via the line 1, on the measurable parameters is processed into control variables. The hitherto described configuration of the control system is known from the USTER News Bulletin No. 27 of August 1979 "The recording of thread breaks in the ring spinning works". The migration sensor is also described in CH-A-601 093 (=U.S. Pat. No. 4,122,657).

The motor drive MA receives on a line 2 a regulated variable, to adjust the drive of the ring spinning machine RS with reference to the control variables obtained in the control stage ST. What is essential in the system shown in FIG. 1 is now the fact that the central stage ST receives not only information on the measurable parameters, but also information on non-measurable parameters, and that also the last-mentioned parameters are taken into consideration in obtaining the control variables. The control stage ST receives the information on the measurable parameters from the sensors connected to the machine station and the information on non-measurable parameters from the input station ES connected to the machine station MS via a line 3.

The traditional control technology, whether this be condition controllers, P controllers (controllers with proportional component, i.e. with one setting parameter), PI controllers (controllers with a proportional and integral component, i.e. with two setting parameters), PID controllers (controllers with a proportional, integral and differential component, i.e. with three setting parameters) or the like, presupposes that the interrelationships of the process to be controlled are known and describable and can be imaged in a model. This modelling also includes disturbance variables, such as for example temperature drift, in which connection it is also known to integrate the disturbance variables into the control system in such a manner that they do not have a disadvantageous effect on the control process. However, in this case also, a mathematical interrelationship must exist between disturbance variable and control variable. If this is not the case, then the control system, apart from fortuitous incidents, will fail.

On the other hand, however, the speed of rotation of the spindles, which essentially determines the production of the ring spinning machine, is dependent not only upon the parameters monitored and measured by the sensors mentioned, but also upon relevant quantities, such as for example climate, airborne dust, air circulation or also upon subjective and individual parameters of the operating personnel, such as for example their workload. These additional relevant quantities can be classified in two respective classes on the basis of two different criteria; in this case, the two groups of classes may be in some cases overlap.

If the technical measurability of the relevant quantities or parameters is selected as the first criterion, then it is possible to classify the parameters into technically measurable and technically non-measurable ones. If the criterion adopted is the possibility of the creation of a mathematical interrelationship between parameters and control variables, then it is possible to classify the parameters into those with and those without a mathematical interrelationship with the pertinent control variable. The control system shown in FIG. 1 is intended to permit all four mentioned classes of parameters to be included in the control system. This is achieved by a synthesis of conventional adaptive control and fuzzy logic.

With respect to the fuzzy logic, reference is made to the literature, which has meanwhile become extensive, on this topic, for example to the book "Fuzzy Set Theory and its Applications" by H. J. Zimmermann, Kluwer Academic Publishers, 1991. The so-called fuzzy sets were introduced 25 years ago, in order to describe mathematically non-exact and incomplete data sets, as frequently occur in the real world (pictures, subjective descriptions). While the classical control logic exhibits only the two definite values yes or no, 0 or 1, the fuzzy logic acknowledges an association function, which can adopt any selectable values in order to describe the association of an object with a specified quantity within the range 0 to 1.

Where control technology is implemented with the aid of the fuzzy set theory, in this case the fundamental idea is then to allow the experiences of a human process operator to play a part in the design of the controller. In this case, proceeding from a set of linguistic rules, which describe the control strategy of the operator, a control algorithm is formulated, in which the words are defined as fuzzy sets. In this way, experiences and intuition can be implemented, and no process model is required.

The mentioned synthesis of the conventional adaptive control and the fuzzy logic is effected in specific terms by the following four measures:

1. Measurement of the technically measurable parameters by sensors. These parameters are for example the following:
   - air temperature in °C.,
   - air humidity in mg/m$^3$,
   - thread break level in number of thread breaks per 1000 spindle hours,
   - statistically poor spinning locations (these are those spindles which produce statistically too many thread breaks, i.e. which deviate from the mean value by more than 3%),
   - low speed spindles (i.e. spindles with markedly deviating speeds of rotation, which leads to a loss of rotation and thus to an alternate yarn character, especially to a lower tensile strength),
   - electric field in V/m, etc.
2. Notification of the technically non-measurable parameters to the system by input at the input station ES in accordance with human perception. Such parameters are for example certain climatic factors which are difficult to record, such as tendency to thunderstorm (no, moderate or great tendency to thunderstorm), or subjective factors, such as for example the workload of the operator (too low, moderate, too great), etc.
3. Inclusion of those parameters in the case of which a mathematical interrelationship with the control variable can be derived, in the control system by conventional control algorithms.
4. Inclusion of those parameters in the case of which a mathematical interrelationship with the control variable cannot be derived, in the control system by means of fuzzy logic.

Finally, the control system is designed so that further parameters, which are not yet currently known, can be defined, whether these be technically measurable or technically non-measurable. Moreover, it is possible to input into the control system what relation is expected between parameter and control variable.

The practical conversion of these four measures takes place in the steps of determination of the parameters, definition of the parameters and of their relation to the control variable, and finally evaluation of the relations. The determination of the technically measurable parameters takes place in a similar way to that applicable when using USTER RINGDATA, i.e. these parameters are measured automatically by sensors and are transmitted on to the control system. By way of example, thread breaks are recorded by the already mentioned migration sensor, which measures the speed of rotation of the drivers at each spindle and interprets a driver speed of rotation of zero revolutions per unit time as a thread break. Thus, the migration sensor records the speed of rotation of the spindle and the thread breaks and delivers the corresponding data to the machine station MS, from where they pass via the line 1 into the control stage ST and thus into the process management system.

Figure 2:
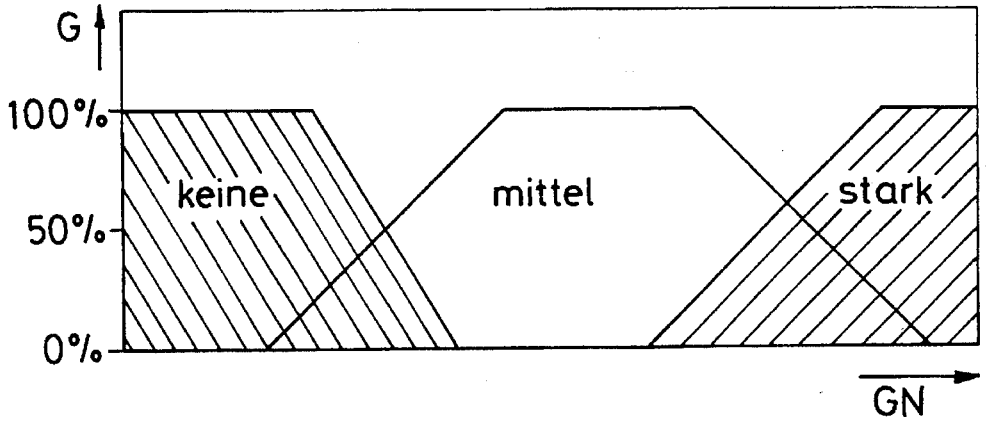
FIG. 2 shows a diagram with fuzzy sets.

Parameters which are technically non-measurable or measurable only with great expenditure are in the first instance provided with a name and subsequently defined. Thus, by way of example, tendency to thunderstorm is the name for the probability of the gathering of a thunderstorm. It is dependent upon various factors, inter alia upon the general weather situation, the air pressure, the local electric field, the local ionization of the air, etc. To provide a definition of the tendency to thunderstorm, for example, all operators of a spinning works are asked what tendency to thunderstorm they subjectively perceive, and the degree of the perceived tendency to thunderstorm is allocated to one of three classes (no, moderate or great tendency to thunderstorm). These statements are compared with the tendency to thunderstorm objectivized by details from meteorological specialists, and the three classes mentioned are compiled in the manner evident from FIG. 2. In this case, each class is for example a trapezoidal fuzzy set, with the tendency to thunderstorm GNU on the abscissa and with the weighting G on the ordinate. It is typical of these sets that overlap regions of the individual conditions exist, in which a plurality of conditions can be allocated to unambiguous values of the tendency to thunderstorm on the x axis.

In the control system shown in FIG. 1, a fuzzy controller FC is disposed between the control system ST and the motor drive MA. This fuzzy controller comprises a control base 4 and an interference machine 5 for the premises and an action interface 6 for the conclusions. Strictly speaking, the input station ES acting as operating interface is also a component part of the fuzzy controller FC.

The design of the fuzzy controller FC is, broadly, executed in the following steps:

Definition of all input and output variables

Definition of the indefinite quantities for the linguistic variables which represent the input and output quantities. Linguistic variables are words and expressions of the colloquial language or of a natural language; in the example of FIG. 2, the linguistic variable is called "tendency to thunderstorm". This variable is intended to be able to adopt as values the natural language expressions (no, moderate, great); in this case, these expressions are names for the fuzzy sets represented in FIG. 2.

Setting up of the rules

Specification of the interference machine. The majority of commercial systems permit the choice between the minimum and the algebraic product operator. The minimum operator is the operator for the average of two fuzzy sets, and the algebraic product operator is an operator from the class of T norms, i.e. dual-value functions from the range [0.1]× [0.1], which are inter alia monotonic and satisfy the commutative law and the associative law.

Definition of the computation of the definite output quantities

Optimization of the controller behavior.

As has already been mentioned, in the control system shown in FIG. 1 when defining the input variables and their relation to the control variable a distinction is drawn between unambiguously describable and nonmathematically describable relations. Unambiguously describable relations are the thread breaks and the climate.

The control of the speed of rotation with reference to the thread breaks is an adaptive control, in which case the following parameters can be input into the system:

Setting of the theoretical thread break level

Setting of that magnitude of deviation of the thread break level as from which control is to be implemented Consideration of the outlier and/or the low speed spindles Consideration of all other relevant parameters with reference to the degree of truth of the rules Setting up the sequential interval (=time window to be observed for the measured variable)

Setting up the change of speed of rotation per control step.

The control of the speed of rotation with reference to the climatic data is in principle a condition control which is expanded by consideration of the degrees of truth of the other relevant parameters to form an adaptive control. The system already has integrated therein a table of the spinnability of yarns as a function of temperature and air humidity; the following parameters can be notified to the system:

Yarn number

Adaptation of the table, integrated in the system, of the spinnability of yarns as a function of temperature and air humidity Setting up that magnitude of deviation of the climate (temperature and air humidity) as from which control is to be implemented Setting up the change of speed of rotation per control step.

Besides the unambiguously describable relations, the control system further acknowledges the following relations between the individual relevant quantities (input variables) and the control variable:

a. the greater the relevant quantity, the smaller the control variable, b. the smaller the relevant quantity, the greater the control variable, c. the smaller the relevant quantity, the smaller the control variable, d. the greater the relevant quantity, the greater the control variable, e. all combinations from a to d linked with all relevant quantities.

Further, the degree of truth, to be expected, of the relations can be input into the system, whereby a continuous adaptation of the system with reference to empirical values takes place.

For the evaluation of the relations, limiting values for the speeds of rotation are input into the system, within which speeds of rotation the control may operate (minimum lower maximum upper speed of rotation). Moreover, in the evaluation the input change of speed of rotation, i.e. the reduction or increase of the speed of rotation, per control step and per quantity recorded is used.

In the case of thread breaks, in the event of exceeding or falling below the theoretical thread break level over the period of observation of the sequential interval, the control of the speed of rotation takes place stepwise within the permissible speed of rotation range having regard to and following the degree of truth.

Figure 3:
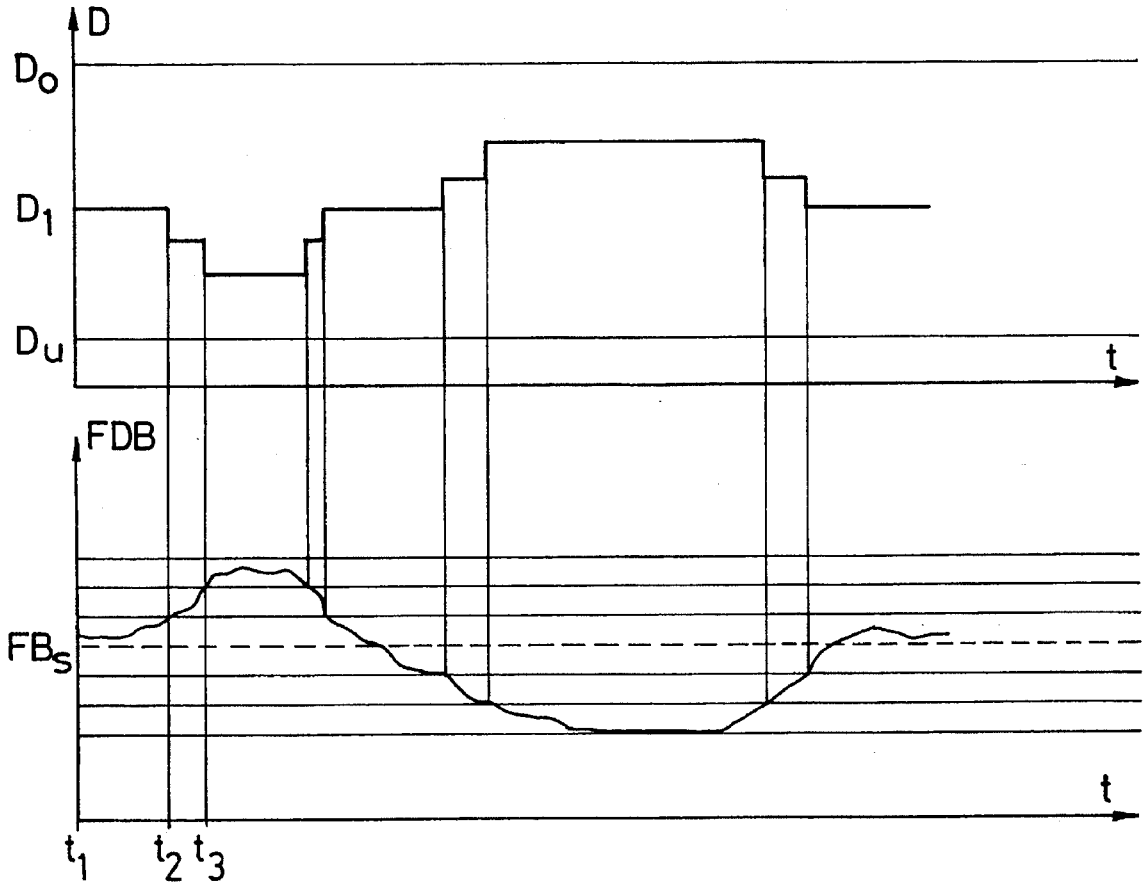
FIG. 3 shows a graphical representation of the control of the speed of rotation of a ring spinning machine with reference to the number of thread breaks.

FIG. 3 shows a graphical representation of the control of the speed of rotation of a ring spinning machine with reference to the number of thread breaks. In the upper half of the figure, the speed of rotation D (in revolutions per minute) and in the lower half the thread break rate FDB (in the number of thread breaks per thousand spindle running hours) is plotted respectively against the time t. Moreover, the permissible maximum upper speed of rotation Do, the permissible minimum lower speed of rotation Du, the theoretical thread break level FBs as well as limits, situated symmetrically with respect to the latter and spaced by 5% in each instance for the deviations of the thread break rate are shown.

In accordance with the representation, the ring spinning machine runs at the instant $t_1$ at a speed of rotation $D_1$, at which point the thread break rate is just above the theoretical thread break level $FB_s$. At the instant $t_2$, the thread break rate exceeds the limit $FB_s$+5%, whereupon the speed of rotation is lowered by the set amount. Since the thread break rate does however increase further and at the instant $t_3$ exceeds the limit $FB_s$+10%, and since also the time $t_2$–$t_1$ is greater than the set sequential interval, at this instant the speed of rotation D is lowered afresh by the set amount, and so on.

In the case of the relevant factor climate (air temperature, air humidity), the control takes place in a similar manner to that applicable in the case of thread breaks. In the event of exceeding or falling below the theoretical temperature or the theoretical humidity, the speed of rotation is altered stepwise within the permissible speed of rotation range.

In the case of the non-mathematically describable relations, the control of the speed of rotation takes place with reference to the input rules a to e; in this case, the computation of the output variables preferably takes place by means of formation of the centre of area (CoA) or formation of the mean of maximum (MoM).

I claim:

1. A system for regulating the operation of a spinning machine to optimize its production, comprising:

sensors for measuring parameters relating to the operation of a spinning machine;

a control system responsive to the measured parameters for generating control variables having an unambiguous mathematical relationship to respective measured parameters;

means for entering other parameters which are not measurable with sensors; and a fuzzy logic controller which receives the control variables generated by said control system and other parameters which do not exhibit an unambiguous mathematical relationship to control variables, for a generating regulated variable for controlling the operation of the spinning machine.

2. A system according to claim 1, further including a motor driver responsive to said regulated variable for controlling a spinning machine, wherein said fuzzy logic controller is connected in series between said control system and said motor driver.

3. The system according to claim 2, wherein said entering means inputs said other parameters into said fuzzy logic controller in accordance with human perceptions corresponding to fuzzy sets with differing values.

4. The system according to claim 3, wherein said other parameters relate to subjective environmental or ambient factors.

5. The system according to claim 1, wherein said other parameters relate to a tendency for a thunderstorm.

6. The system according to claim 3, wherein said other parameters relate to operating personnel workloads.

7. The system according to claim 1, wherein said regulated variable controls the speed of rotation of a spinning machine, and further including means defining theoretical values for at least some of said parameters and a permissible range for the speed of rotation, and wherein said regulated variable controls the speed of rotation in discrete steps.

* * * * *